US007438398B2

(12) United States Patent
Lee

(10) Patent No.: US 7,438,398 B2
(45) Date of Patent: Oct. 21, 2008

(54) INK CARTRIDGE AND INKJET PRINTER USING THE SAME

(75) Inventor: Young-Su Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 213 days.

(21) Appl. No.: 11/020,129

(22) Filed: Dec. 27, 2004

(65) Prior Publication Data

US 2006/0007275 A1 Jan. 12, 2006

(30) Foreign Application Priority Data

Jul. 12, 2004 (KR) ..... 10-2004-0054144

(51) Int. Cl.
*B41J 2/17* (2006.01)
*B41J 2/175* (2006.01)

(52) U.S. Cl. ..... 347/84; 347/86

(58) Field of Classification Search ..... 347/84, 347/86

See application file for complete search history.

(56) References Cited

U.S. PATENT DOCUMENTS

| | | | | |
|---|---|---|---|---|
| 5,835,111 | A * | 11/1998 | Balazer | 347/50 |
| 6,086,193 | A * | 7/2000 | Shimada et al. | 347/86 |
| 6,257,710 | B1 * | 7/2001 | Haigo | 347/84 |
| 6,312,087 | B1 * | 11/2001 | Imai et al. | 347/23 |
| 6,325,499 | B1 | 12/2001 | Betschon | |
| 6,422,691 | B2 * | 7/2002 | Kobayashi et al. | 347/86 |
| 6,578,957 | B2 * | 6/2003 | Higuma et al. | 347/86 |
| 6,623,092 | B2 | 9/2003 | Kim et al. | |
| 6,776,477 | B2 * | 8/2004 | Putman et al. | 347/84 |
| 2003/0085971 | A1 * | 5/2003 | Hou et al. | 347/87 |
| 2004/0227797 | A1 * | 11/2004 | Shimizu et al. | 347/93 |
| 2005/0057618 | A1 * | 3/2005 | Bybee et al. | 347/85 |
| 2005/0174401 | A1 * | 8/2005 | Jung et al. | 347/86 |

(Continued)

FOREIGN PATENT DOCUMENTS

DE 19540472 10/1995

(Continued)

OTHER PUBLICATIONS

Chinese Office Action dated Feb. 9, 2007 issued in CN 2005100659503.

(Continued)

*Primary Examiner*—An H. Do
*Assistant Examiner*—Sarah Al Hashimi
(74) *Attorney, Agent, or Firm*—Stanzione & Kim, LLP

(57) ABSTRACT

An ink cartridge and an inkjet printer using the same. The ink cartridge includes a cartridge case having an ink storing space, negative pressure forming foam inserted into the cartridge case, and a filter pipe installed on a bottom surface of the cartridge case, wherein the bottom surface of the cartridge case is formed to be entirely in contact with a bottom surface of the foam. Thus, a dead space around the filter pipe is minimized or eliminated, therefore solving a problem where the ink would otherwise remain to a certain extent in the dead space. In addition, the air existing in the dead space together with the ink does not affect the ink ejection performance of a head due to expansion and shrinkage of the air to stably maintain the ink ejection performance.

19 Claims, 6 Drawing Sheets

U.S. PATENT DOCUMENTS

2006/0103701 A1* 5/2006 Chan ..... 347/86

FOREIGN PATENT DOCUMENTS

JP 06-000966 1/1994

JP 2002-19141 1/2002

OTHER PUBLICATIONS

Korean Office Action dated Jan. 27, 2006 issued in KR 2004-54144.
Korean Office Action dated Jan. 27, 2006 issued in KR 2004-54144.

* cited by examiner

INK CARTRIDGE AND INKJET PRINTER USING THE SAME

CROSS-REFERENCE TO RELATED APPLICATIONS

This application claims the benefit of Korean Patent Application No. 2004-54144 filed on Jul. 12, 2004, the disclosure of which is hereby incorporated herein by reference and in its entirety.

BACKGROUND OF THE INVENTION

1. Field of the Invention

The present general inventive concept relates to an ink cartridge and an inkjet printer using the same, and more particularly, to an installation structure between a bottom surface of an ink cartridge and a filter pipe located on the bottom surface of the ink cartridge to press foam filled in the cartridge.

2. Description of the Related Art

An inkjet printer is a device used to print an image by ejecting fine ink droplets on a surface of a recording medium in a desired shape, which uses an ink cartridge as a means for storing and ejecting ink. Generally, the ink cartridge has an ink storing space therein, which is integrally formed with ejecting means for ejecting the stored ink or separately formed with the ejecting means.

FIG. 1 is a cross-sectional view illustrating an integrated ink cartridge, a filter pipe 12 is formed on a bottom surface 10*a* of a synthetic resin cartridge case 10, and the ink is supplied to the ejecting means through the filter pipe 12. The filter pipe 12 is integrally formed with the cartridge case 10 provided with an inkjet head 14 on its bottom surface to eject the ink to an exterior thereof. Meanwhile, foam 16 is filled in the cartridge case 10 to form an appropriate negative pressure in the ink cartridge to prevent the ink from leaking out of the ink cartridge, thereby stably ejecting the ink through the inkjet head 14.

Therefore, the ink is absorbed and stored in the foam 16, as shown in FIG. 1, and the filter pipe 12 is protruded from the bottom surface 10*a* by a predetermined extent to press the foam 16 around the filter pipe when the foam 16 is inserted into the cartridge case 10. The pressed foam strongly absorbs the ink due to a large capillary force in comparison with unpressed foam, and as a result, the ink may be stably supplied into the filter pipe 12.

When the ink is introduced into the ink cartridge fabricated as above through ink introducing means (not shown), the ink is filled first from the bottom surface 10*a* of the ink cartridge to be absorbed into the entire foam evenly. However, a space at which the foam is not filled is generated in regions A and B around the filter pipe due to morphologic properties of the filter pipe 12.

In particular, as shown in FIG. 2, a groove C having a depth extended from the bottom surface 10*a* to a position in the vicinity of the head attachment portion is formed around the filter pipe 12. Although the groove C is formed to prevent the filter pipe 12 from shrinking while manufacturing the cartridge case by injection molding to thereby ensure dimension stability, when the ink is filled in the cartridge, the ink is gathered with air in the spaces A, B and C without being absorbed into the foam.

Since the ink gathered in the spaces A, B and C does not contact the foam, it is difficult to make the foam absorb the ink, thereby decreasing ink use efficiency. In addition, though the ink is absorbed and used, there remains an empty space where the air is filled. In this state, the air filled in the space is shrunk or expanded depending upon changes of temperature and pressure, thereby causing a level of the ink stored in the foam to be changed, and causing the ink to leak to decrease a usage amount of the ink. Further, a filter (not shown) for filtering impurities contained in the ink is mounted on an upper surface of the filter pipe 12, and therefore the air may be gathered on the filter to block a part of the filter, or the air may be introduced into the head to deteriorate ejection performance of the head.

SUMMARY OF THE INVENTION

Accordingly, the present general inventive concept provides an ink cartridge capable of increasing ink use efficiency and stabilizing ejection performance of a head by minimizing or eliminating a dead space around a filter pipe.

The present general inventive concept also provides an ink cartridge capable of stably supplying ink into a filter pipe by uniformly pressing foam located around the filter pipe.

The present general inventive concept also provides an inkjet printer using the ink cartridge.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an ink cartridge including a cartridge case having an ink storing space; negative pressure forming foam inserted into the cartridge case; and a filter pipe installed on a bottom surface of the cartridge case, wherein the bottom surface of the cartridge case is formed to be entirely in contact with a bottom surface of the foam.

That is, the present general inventive concept is capable of increasing ink use efficiency and preventing performance of the head from lowering due to remaining air by eliminating dead space such as a shrink prevention portion of the bottom surface of the cartridge case to actually contact the entire bottom surface of the cartridge case with the bottom surface of the foam. In addition, the shrink prevention portion is formed at a region of the cartridge case adjacent to the filter pipe and is preferably separated from an inner space of the cartridge case to prevent the ink from gathering.

The shrink prevention portion may have an arbitrary shape, for example, a groove shape having a polygonal cross-section. The shrink prevention portion can have a rectangular cross-sectional groove shape. In addition, the shrink prevention portion may have an opened shape, and may have a separate cover to close the opened portion after ejection of the ink.

Meanwhile, the filter pipe may protrude from the bottom surface of the cartridge case by a predetermined extent to press the foam. In this case, since the foam is likely to not be in full contact with the bottom surface at a region connected between the filter pipe and the cartridge case, an upper surface of the filter pipe and the bottom surface of the cartridge case can be continuously connected to each other by a sloped surface. The sloped surface may have a shape of a flat surface or a shape of a curved surface.

A filter is installed at the upper surface of the filter pipe, and a step is formed at the region connected between the sloped surface and the upper surface of the filter pipe to form a filter reception portion to insert the filter. At this time, the step can have a height equal to a thickness of the filter.

In addition, the bottom surface can have at least two flat surfaces having a different height from each other, and the filter pipe may be installed on the uppermost flat surface. That is, the bottom surface is formed to have a stairway shape, the filter pipe is formed at the uppermost portion, and the foam is pressed by a flat surface located at the uppermost portion rather than around the filter pipe. The flat surface may press the foam more uniformly to minimize the dead space and make the ink supply into the filter pipe smooth.

Each of the flat surfaces can be continuously connected to each other through the sloped surface to improve the contact properties with the foam, and the step can be formed at the region connected between the uppermost flat surface and the upper surface of the filter pipe to form the filter reception portion.

The foregoing and/or other aspects and advantages of the present general inventive concept are also achieved by providing an inkjet printer using the ink cartridge described above.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
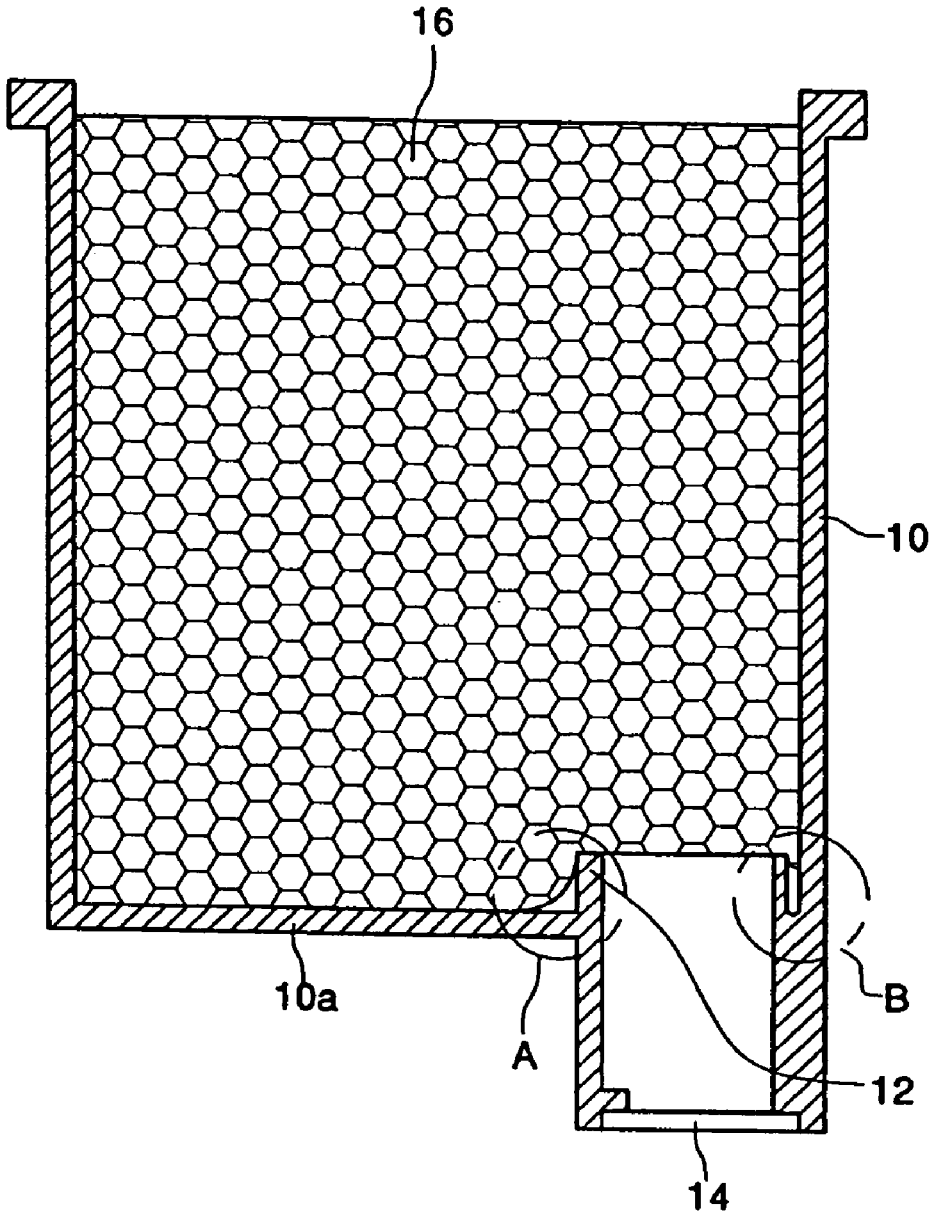
FIG. 1 (PRIOR ART)
FIG. 1 is a cross-sectional view illustrating a conventional ink cartridge.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
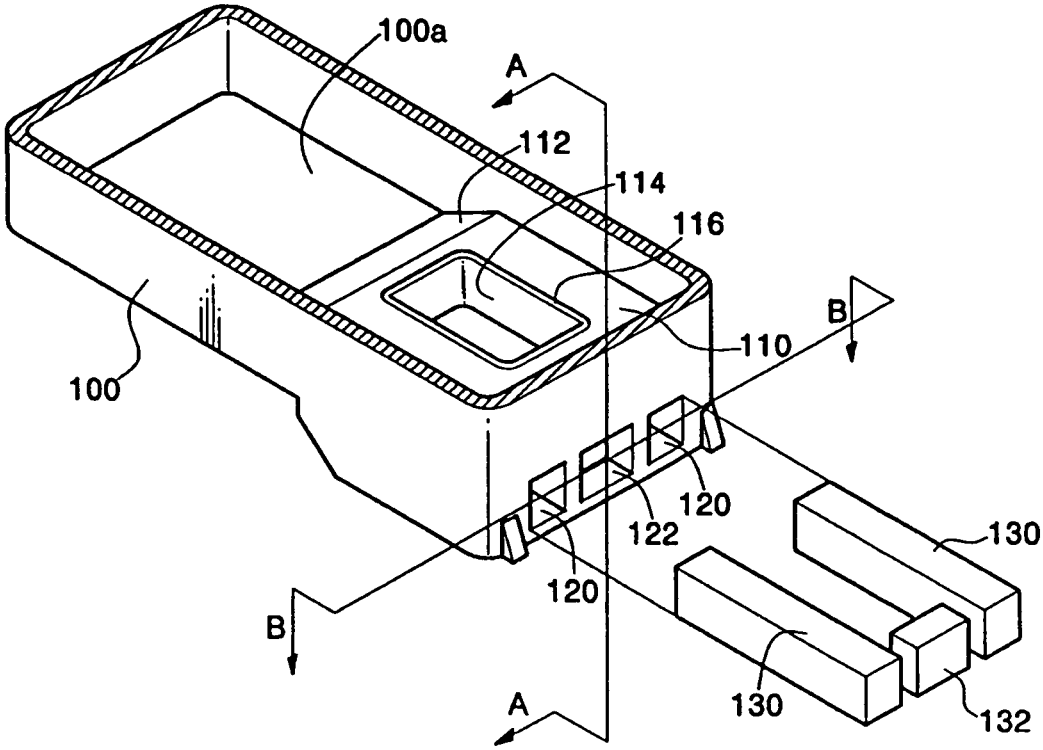
FIG. 3 is a perspective view illustrating a first embodiment of an ink cartridge in accordance with an embodiment of the present general inventive concept.

Referring to FIG. 3, an external form of a cartridge case 100 of this embodiment is similar to that of a conventional cartridge case, and therefore, a detailed description of its upper portion is omitted in order to illustrate its inner structure. A bottom portion of the cartridge case 100 has two flat surfaces 100*a* and 110, each of which is referred to as a bottom surface 100*a* and a foam-pressing surface 110.

The bottom surface 100*a* supports foam inserted into the cartridge case 100, and the foam-pressing surface 110 protrudes upward from the bottom surface 100*a* to press the foam located thereon by the protruding amount. Therefore, the foam pressed by the foam-pressing surface 110 may absorb a large amount of ink in comparison with unpressed foam. The bottom surface 100*a* and the foam-pressing surface 110 are continuously connected to each other by a sloped surface 112. As a result, the foam is uniformly in contact with the bottom surface 100*a* and the foam-pressing surface 110 as a whole to minimize a dead space. In FIG. 3, the sloped surface 112 is illustrated as having a flat surface, but may have a curved surface in order to improve a contact property with the foam.

Figure 4:
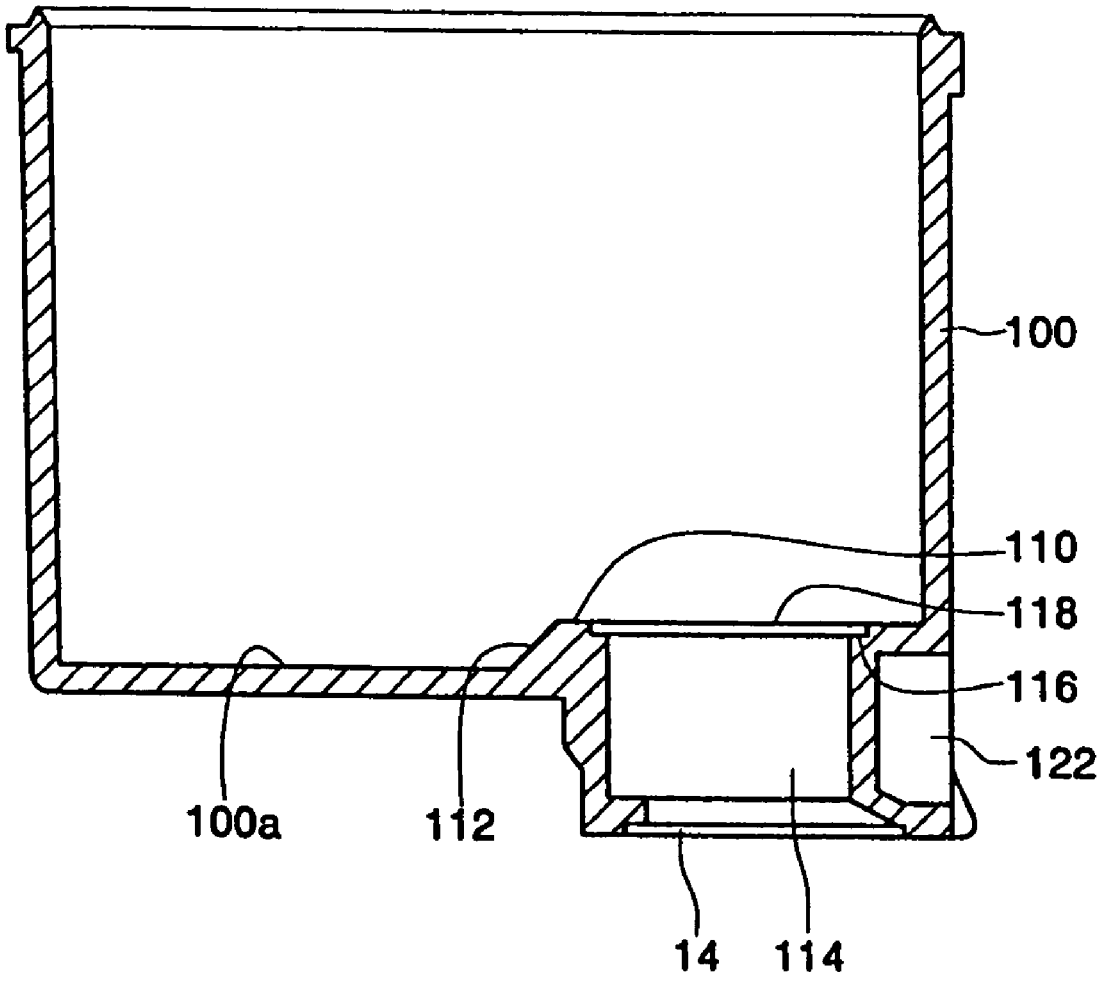
FIG. 4 is a cross-sectional view of the ink cartridge of FIG. 3 taken along the line A-A.

A rectangular hole 114 functioning as a filter pipe can be formed at a center of the foam-pressing surface 110, and can be provided with a filter reception portion 116 to mount a filter (118 in FIG. 4) at its periphery. The filter reception portion 116 is formed to have a step around the periphery of the hole 114 in the foam-pressing surface 110, of which a depth is equal to a thickness of the filter to be mounted thereon. Therefore, the filter may be accurately mounted on an upper end of the hole 114 to prevent the mounted filter from separating during its fixing process. A head 14 is mounted on a lowermost surface of the hole 114.

Figure 5:
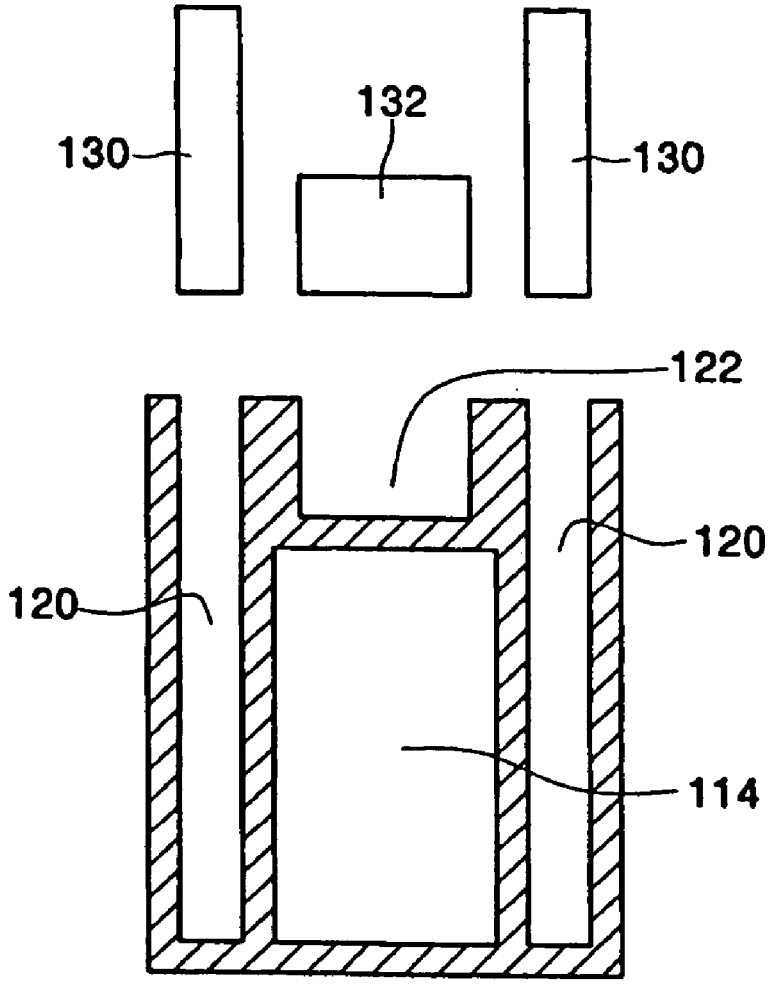
FIG. 5 is a cross-sectional view of the ink cartridge of FIG. 3 taken along the line B-B.

Meanwhile, three shrink prevention portions 120 and 122 are formed at a front lower portion of the cartridge case 100. The shrink prevention portions include a pair of first shrink prevention portions 120 located at both sides of the front lower portion of the cartridge case 100, and a second shrink prevention portion 122 located at the center of the front lower portion of the cartridge case 100, each of which has a shape of a rectangular groove. As shown in FIG. 5, the first shrink prevention portions 120 extend from a front surface of the cartridge case 100 to a distal end of the hole 114, and the second shrink prevention portion 122 extends from the front surface of the cartridge case 100 to a proximal end of the hole 114 so that a wall of the case surrounding the hole and the shrink prevention portions has a uniform thickness. As a result, the case manufactured by an injection molding method is uniformly shrunk during its solidification process after the injection to facilitate its forming.

Reference numerals designated as 130 and 132 in FIGS. 3 and 5 are slide cores to form the shrink prevention portions. That is, the slide cores are inserted into an injection mold during the injection molding to form desired shaped shrink prevention portions 120 and 122. The slide cores may be integrally formed with one another, or may be separately formed with respect to one another. In addition, the shrink prevention portions 120 and 122 may be formed to be exposed externally, as shown, or may be provided with a separate cover to be enclosed thereby.

Figure 6:
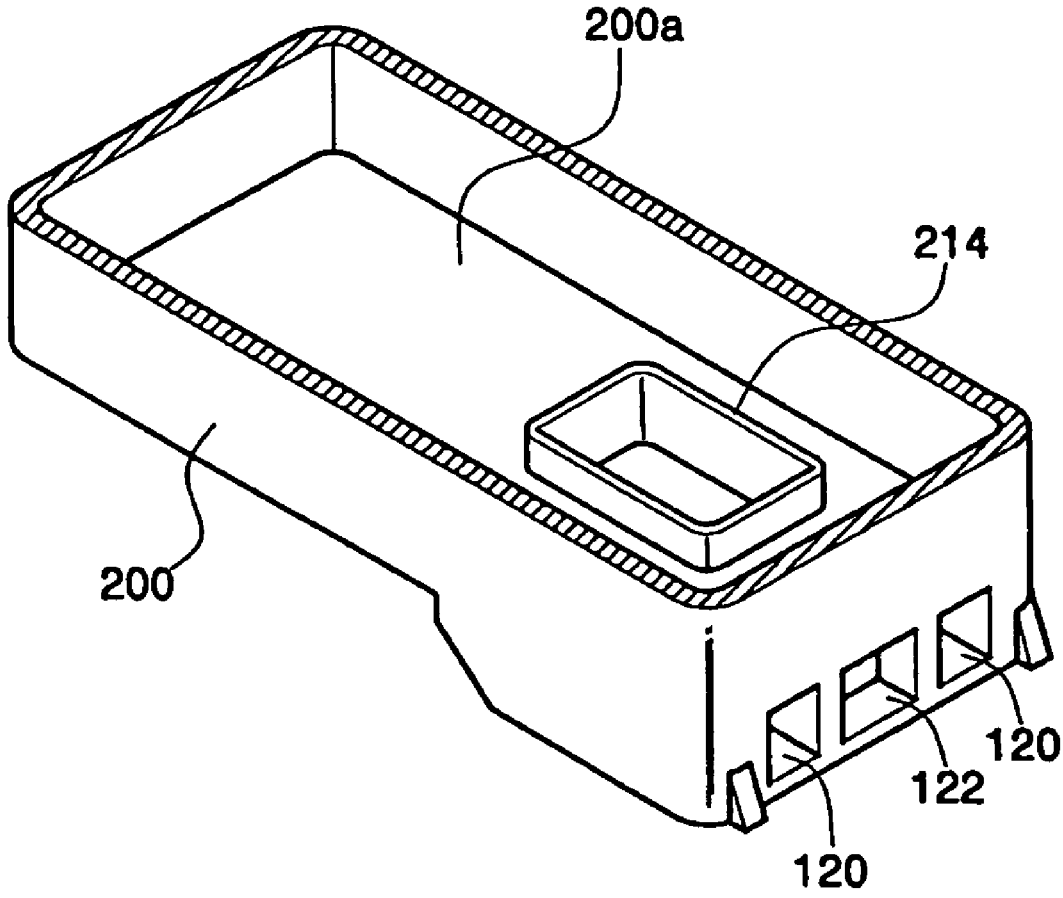
FIG. 6 is a perspective view illustrating an ink cartridge in accordance with another embodiment of the present general inventive concept.

FIG. 6 shows an ink cartridge in accordance with another embodiment of the present general inventive concept. The present embodiment shown in FIG. 6 basically has a structure similar to that of the previous embodiment shown in FIG. 3, except that the cartridge case 200 is provided with a bottom surface 200*a* formed with a single flat surface as a whole. In addition, a filter pipe 214 protrudes from the bottom surface 200*a* to press the foam. Of course, a part of a region connected between the filter pipe 214 and the bottom surface 200*a* may not be in contact with the foam. However, since the part of the region between the filter pipe 214 and the bottom surface 200*a* has a very small area in comparison with the entire area of the bottom surface 200*a*, the same effect results as would result if the entire bottom surface 200*a* were actually in contact with the foam, and the effect on ink ejection performance is negligible since the air in the region between the filter pipe 214 and the bottom surface 200*a* not in contact with the foam has a very small volume. The design of the ink cartridge case 200 of FIG. 6 can be provided since shrink prevention portions 120 and 122, similar to those described in the embodiment of FIG. 3, are provided along an external side of the bottom surface 200*a*.

Figure 2:
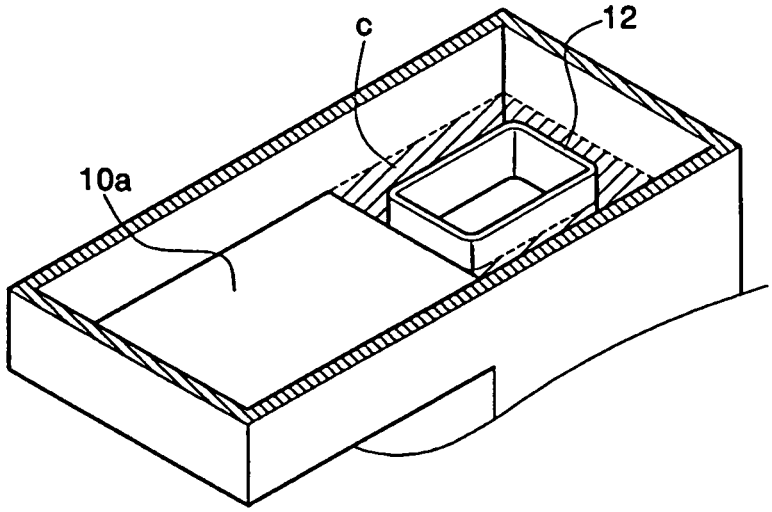
FIG. 2 (PRIOR ART)
FIG. 2 is a perspective view illustrating a filter pipe portion of the ink cartridge shown in FIG. 1.

In other words, while the conventional ink cartridge case 10 (see FIG. 2) has a shrink prevention portion C that extends to a head mounting portion around the filter pipe 12 and inside the ink cartridge case 10, resulting in a large amount of dead space between the shrink prevention portion C and a negative pressure forming foam, the present embodiment shown in FIG. 6 is provided with the shrink prevention portions 120 and 122 located at the exterior of the ink cartridge case 200 to decrease dead space therein.

Figure 7:
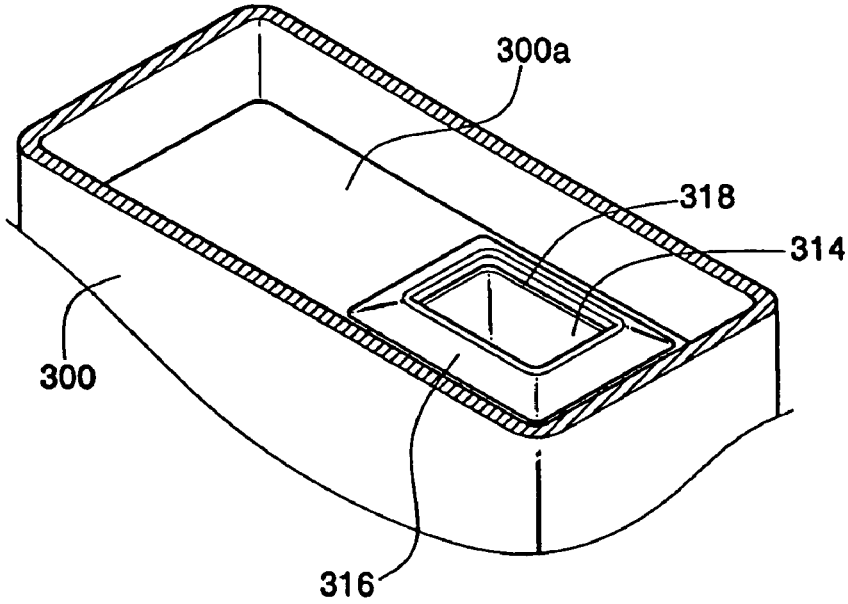
FIG. 7 is a perspective view illustrating an ink cartridge in accordance with still another embodiment of the present general inventive concept.
Figure 8:
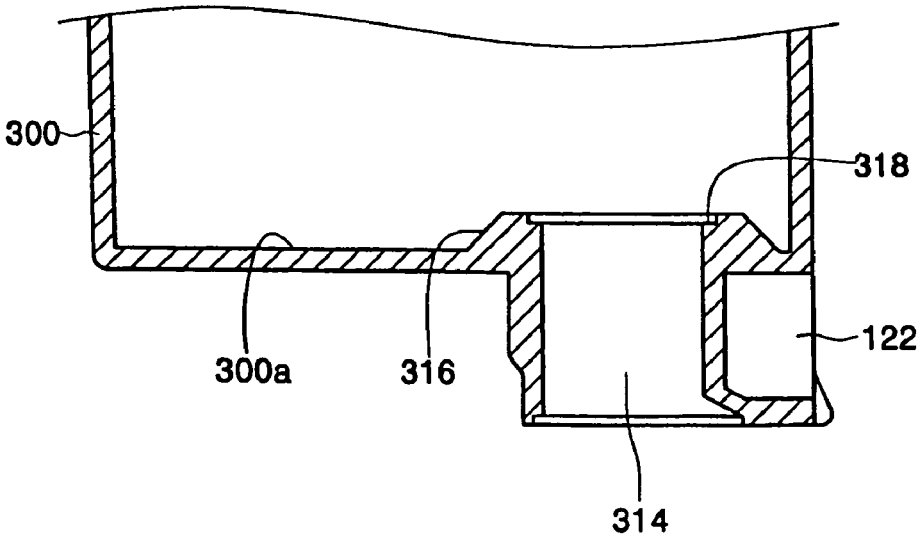
FIG. 8 is a cross-sectional view illustrating the ink cartridge according to the embodiment shown in FIG. 7.

FIG. 7 shows an ink cartridge in accordance with another embodiment of the present general inventive concept. The embodiment shown in FIG. 7 is basically similar to that of the previous embodiment shown in FIG. 6, except that a square pyramidal protrusion 316 is formed on a bottom surface 300*a* of a cartridge case 300 to press the foam, and a hole 314 is formed at the center of the protrusion 316 to function as the filter pipe. That is, the present embodiment shown in FIG. 7 is provided with sloped surfaces around the filter pipe to improve the contact properties with the foam.

In particular, in the embodiment shown in FIG. 7, the foam may be uniformly and symmetrically pressed about the hole 314 to improve ink-supply properties into the hole 314. Meanwhile, a filter reception portion 318 is formed at a periphery of the hole 314 to facilitate attachment of the filter, similarly to the embodiment shown in FIG. 3.

As can be seen from the foregoing, a dead space that would otherwise exist around the filter pipe may be minimized or eliminated, thus solving a problem where the ink would otherwise remain to a certain extent in the dead space. In addition, the air that exists in the dead space together with the ink does not affect the ink ejection performance of the head due to expansion and shrinkage of the air to stably maintain the ink ejection performance.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink cartridge comprising:

a cartridge case having an ink storing space;

a negative pressure forming foam inserted into the cartridge case; and a filter pipe installed to protrude from a bottom surface of the cartridge case and toward the foam by a determined amount such that the bottom surface of the cartridge case is formed to be entirely in contact with a bottom surface of the foam.

2. The ink cartridge according to claim 1, wherein the cartridge case further comprises a shrink prevention portion formed at a region adjacent to the filter pipe and the shrink prevention portion is separated from an inner space of the cartridge case.

3. The ink cartridge according to claim 2, wherein the shrink prevention portion has a polygonal cross-sectional groove.

4. The ink cartridge according to claim 1, wherein the bottom surface of the cartridge case and an upper surface of the filter pipe are continuously connected to each other by a sloped surface.

5. The ink cartridge according to claim 4, wherein a step is formed at a region between the sloped surface and the upper surface of the filter pipe to form a filter reception portion to insert a filter.

6. The ink cartridge according to claim 1, wherein the bottom surface has at least two flat surfaces having a different height with respect to each other, and the filter pipe is installed on an uppermost flat surface.

7. The ink cartridge according to claim 6, wherein the flat surfaces are continuously connected to each other through the sloped surface.

8. The ink cartridge according to claim 7, wherein a step is formed at a region between the uppermost flat surface and the upper surface of the filter pipe to form a filter reception portion to insert a filter.

9. An inkjet printer using an ink cartridge comprising a cartridge case having an ink storing space, a negative pressure forming foam inserted into the cartridge case, and a filter pipe protruding from a bottom surface of the cartridge case and toward the foam, wherein the cartridge case further comprises a shrink prevention portion formed at a region adjacent to the filter pipe such that the bottom surface of the cartridge case is formed to be entirely in contact with a bottom surface of the foam.

10. An ink cartridge including a negative pressure forming foam provide therein, comprising:

side walls forming a rectangular body;

a bottom surface having a first portion stepped with respect to a second portion, the negative pressure forming foam in contact with the complete surfaces of the first and second portions of the bottom surface such that the portion of the negative pressure forming foam in contact with the first portion is compressed by the stepped amount and absorbs a greater amount of ink than the portion of the negative pressure forming foam in contact with the second portion;

a filter pipe forming a hole in the first portion and extending downward to eject ink therefrom; and a filter reception portion disposed at a periphery of the filter pipe and having a depth with respect to the first portion equal to a filter to be mounted therein.

11. The ink cartridge according to claim 10, further comprising a sloped surface disposed between the first and second portions of the bottom surface, the sloped surface also being completely in contact with the negative pressure forming foam.

12. The ink cartridge according to claim 11, further comprising shrink prevention portions formed below the first portion of the bottom surface to prevent shrinkage of the ink cartridge.

13. The ink cartridge according to claim 12, wherein the shrink prevention portions comprise:

a first shrink prevention portion extending through one of the side walls and along two opposing outer sides of the filter pipe to a distal end thereof; and a second shrink prevention portion extending through the one side wall to a proximal end of the filter pipe.

14. An ink cartridge including a negative pressure forming foam provide therein, comprising:

side walls forming a rectangular body;

a bottom portion forming a flat surface such that the negative pressure forming foam is in contact with the complete bottom portion;

a filter pipe forming a hole in a part of the bottom portion such that a perimeter of the filter pipe extends up through the bottom portion to press the negative pressure forming foam an amount such that the negative pressure forming foam creates a negative pressure around the filter pipe while remaining in contact with the complete bottom portion of the ink cartridge; and a filter reception portion disposed at a periphery of the filter pipe and having a depth with respect to the first portion equal to a filter to be mounted therein.

15. The ink cartridge according to claim 14, further comprising shrink prevention portions comprising:

a first shrink prevention portion extending through one of the side walls and along two opposing outer sides of the filter pipe to a distal end thereof; and a second shrink prevention portion extending through the one side wall to a proximal end of the filter pipe.

16. An inkjet printer using an ink cartridge comprising a bottom surface having a filter pipe extending therethrough to eject ink and sloped portions surrounding the filter pipe, and a negative pressure forming foam provided inside the ink cartridge and in contact with the complete inner side of the bottom surface such that a negative pressure is created by a portion of the negative pressure forming foam which is in contact with the sloped portions of the bottom surface.

17. An ink cartridge, usable in inkjet printers, comprising:

an ink storage space;

a negative pressure forming foam inside the ink storage space;

a filter pipe installed on a bottom surface of the ink storage space such that the bottom surface of the ink storage space is in contact with substantially an entire bottom surface of the foam; and at least one shrink prevention part formed at at least one region adjacent to the filter pipe.

18. An ink cartridge, usable in inkjet printers, comprising:

an ink storage space;

a negative pressure forming foam inside the ink storage space; and a filter pipe installed on a bottom surface of the ink storage space, having a top surface protruding toward the foam, wherein the top surface of the filter pipe is surrounded with sloped surfaces that connect to the bottom surface of the ink storage space such that the bottom surface of the ink storage space, the sloped surfaces, and the top surface of the filter, are in contact with substantially an entire bottom surface of the foam.

19. The ink cartridge of claim 18, further comprising at least one shrink prevention part formed at at least one region adjacent to the filter pipe.

* * * * *